US012595941B2

(12) United States Patent
Wang et al.

(10) Patent No.: US 12,595,941 B2
(45) Date of Patent: Apr. 7, 2026

(54) HEAT PUMP SYSTEM AND CONTROL METHOD THEREOF

(71) Applicant: Carrier Corporation, Palm Beach Gardens, FL (US)

(72) Inventors: Jinxiang Wang, Shanghai (CN); Xingye Zhou, Shanghai (CN); Zehang Yu, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 236 days.

(21) Appl. No.: 18/455,909

(22) Filed: Aug. 25, 2023

(65) Prior Publication Data

US 2024/0068715 A1 Feb. 29, 2024

(30) Foreign Application Priority Data

Aug. 25, 2022 (CN) ..... 202211025189.0

(51) Int. Cl.
*F25B 30/02* (2006.01)
*F25B 41/20* (2021.01)
*F25B 49/02* (2006.01)

(52) U.S. Cl.
CPC ..... *F25B 30/02* (2013.01); *F25B 41/20* (2021.01); *F25B 49/02* (2013.01); *F25B 2313/02741* (2013.01)

(58) Field of Classification Search
CPC ..... F25B 30/02; F25B 41/20; F25B 49/02; F25B 2313/02741
See application file for complete search history.

(56) References Cited

FOREIGN PATENT DOCUMENTS

| | | | | |
|---|---|---|---|---|
| CN | 114127479 A | * | 3/2022 | ..... F24F 1/10 |
| EP | 1793179 A1 | | 6/2007 | |
| EP | 4040072 A1 | | 8/2022 | |
| KR | 20170126707 A | * | 11/2017 | ..... F25B 1/10 |

OTHER PUBLICATIONS

FOR2, Outdoor unit of refrigeration system, 2016, Full Document (Year: 2016).*
FOR3, Refrigerating device, 2019, Full Document (Year: 2019).*
Extended European Search Report received for EP Application No. 23192020.8, mailed on Jan. 23, 2024, 7 Pages.

* cited by examiner

*Primary Examiner* — Nael N Babaa
(74) *Attorney, Agent, or Firm* — Drew Folgmann

(57) ABSTRACT

A heat pump system comprises: an indoor unit comprising an air conditioning unit and a refrigeration cabinet unit, and an outdoor unit comprising a compressor unit, an outdoor heat exchange unit, and a switching device for selectively connecting the exhaust end of the compressor unit to one of the air conditioning unit and the outdoor heat exchange unit, and connecting the suction end of the compressor unit to the other of the air conditioning unit and the outdoor heat exchange unit; wherein, the outdoor throttling device side of the outdoor heat exchange unit is respectively connected to the first port of the air conditioning unit and the first port of the refrigeration cabinet unit, and the second port of the refrigeration cabinet unit is connected to the suction end of the compressor unit.

14 Claims, 4 Drawing Sheets

HEAT PUMP SYSTEM AND CONTROL METHOD THEREOF

CROSS REFERENCE TO RELATED APPLICATION

This application claims priority to Chinese Patent Application No. 202211025189.0 filed on Aug. 25, 2022, which is incorporated by reference herein in its entirety.

FIELD OF THE INVENTION

The present application relates to the field of refrigeration equipment, in particular to a heat pump system that integrates an air conditioner and a refrigeration cabinet, and a control method thereof.

BACKGROUND OF THE INVENTION

At present, air conditioning systems and refrigeration cabinet systems are the two common refrigeration devices. There maybe refrigerating and heating demands in air conditioning systems, while generally speaking, only refrigeration demands exist in refrigeration cabinet systems. In existing designs, air conditioning systems and refrigeration cabinet systems are usually independent of each other, with separate indoor units, pipelines, and outdoor units. It is expected that the two can be integrated, especially the outdoor units and the indoor and outdoor connecting pipelines of the two, so as to achieve partial heat recovery on the one hand and simplify the number and structure of components on the other hand. The existing integration schemes generally have a complex structure.

SUMMARY OF THE INVENTION

The object of the present application is to solve or at least alleviate the problems existing in the prior art.

According to one aspect, a heat pump system is provided, which comprises:

an indoor unit, comprising:

an air conditioning unit comprising one or more parallel branches, each of which is provided with an air conditioning unit throttling device and an air conditioning unit indoor heat exchanger, wherein the air conditioning unit comprises a first port connected to the air conditioning unit throttling device of each branch and a second port connected to the air conditioning unit indoor heat exchanger of each branch;

a refrigeration cabinet unit comprising one or more parallel branches, each of which is provided with a refrigeration cabinet unit throttling device and a refrigeration cabinet unit indoor heat exchanger, wherein the refrigeration cabinet unit comprises a first port connected to the refrigeration cabinet unit throttling device of each branch and a second port connected to the refrigeration cabinet unit indoor heat exchanger of each branch; and an outdoor unit, comprising:

a compressor unit comprising one or more parallel compressors, wherein the compressor unit comprises a suction end and an exhaust end;

an outdoor heat exchange unit, comprising an outdoor heat exchanger and an outdoor throttling device connected in series with the outdoor heat exchanger; and a switching device for selectively connecting the exhaust end of the compressor unit to one of the air conditioning unit and the outdoor heat exchange unit, and connecting the suction end of the compressor unit to the other of the air conditioning unit and the outdoor heat exchange unit;

wherein, an outdoor throttling device side of the outdoor heat exchange unit is respectively connected to the first port of the air conditioning unit and the first port of the refrigeration cabinet unit, and the second port of the refrigeration cabinet unit is connected to the suction end of the compressor unit.

Optionally, in an embodiment of the heat pump system, the switching device comprises a four-way valve, which comprises a first port connected to the exhaust end of the compressor unit, a second port connected to the suction end of the compressor unit, a third port connected to an outdoor heat exchanger side of the outdoor heat exchanger unit, and a fourth port connected to the second port of the air conditioning unit, wherein the four-way valve is capable of switching between a first position where the first port is connected with the third port and the second port is connected with the fourth port, and a second position where the first port is connected with the fourth port and the second port is connected with the third port. Optionally, the switching device consists of a single four-way valve.

Optionally, in an embodiment of the heat pump system, the heat pump system further comprises a controller configured to enable the heat pump system to execute any of the following modes when the four-way valve is in the first position:

a single air conditioning refrigeration mode, wherein the outdoor heat exchanger serves as a condenser, the air conditioning unit throttling device is used for throttling, and the air conditioning unit indoor heat exchanger serves as an evaporator, with all of the refrigeration cabinet unit throttling devices closed;

a single refrigeration cabinet refrigeration mode, wherein the outdoor heat exchanger serves as a condenser, the refrigeration unit throttling device is used for throttling, and the refrigeration cabinet unit indoor heat exchanger serves as an evaporator, with all of the air conditioning unit throttling devices closed; and an air conditioning and refrigeration cabinet dual refrigeration mode, wherein the outdoor heat exchanger serves as a condenser, a portion of refrigerant is throttled by the air conditioning unit throttling device and returns to the compressor unit after passing through the air conditioning unit indoor heat exchanger and the four-way valve, and the other portion of refrigerant is throttled by the refrigeration cabinet unit throttling device and returns to the compressor unit after passing through the refrigeration cabinet unit indoor heat exchanger; and the controller is configured to enable the heat pump system to execute any of the following modes when the four-way valve is in the second position:

a single air conditioning heating mode, wherein the air conditioning unit indoor heat exchanger serves as a condenser, the outdoor throttling device is used for throttling, and the outdoor heat exchanger serves as an evaporator, with all of the refrigeration cabinet unit throttling devices closed;

an all heat recovery mode, wherein the air conditioning unit indoor heat exchanger serves as a condenser, the refrigeration cabinet unit throttling device is used for throttling, and the refrigeration cabinet unit indoor heat exchanger serves as an evaporator, with the outdoor throttling device closed; and a partial heat recovery mode, wherein the air conditioning unit indoor heat exchanger serves as a condenser, a portion of refrigerant is throttled by the refrigeration cabinet unit throttling device and returns to the compressor unit after passing through the refrigeration cabinet unit indoor heat exchanger, and the other refrigerant is throttled by the outdoor throttling device and returns to the compressor unit after passing through the outdoor heat exchanger and the four-way valve.

Optionally, in an embodiment of the heat pump system, in the all heat recovery mode, when the heating load of the air conditioning unit has been met and the refrigeration load of the refrigeration cabinet unit has not been fully met, the heat pump system switches to the single refrigeration cabinet refrigeration mode, where the heat pump system switches back to the all heat recovery mode after a certain time delay.

Optionally, in an embodiment of the heat pump system, the outdoor heat exchange unit further comprises a subcooling device, which comprises a subcooling heat exchanger and a subcooling throttling device on a subcooling branch, wherein the subcooling heat exchanger is arranged between the outdoor throttling device side and the first port of the air conditioning unit, and the subcooling branch branches out from a main flow path upstream or downstream of the subcooling heat exchanger and is connected to the suction end of the compressor unit through the subcooling throttling device and the subcooling heat exchanger.

Optionally, in an embodiment of the heat pump system, the compressor unit comprises an air conditioning compressor and a refrigeration cabinet compressor connected in parallel, wherein the air conditioning compressor operates when the air conditioning unit is in operation, and the refrigeration cabinet compressor operates when the refrigeration cabinet unit is in operation, where in the event of a failure of the refrigeration cabinet compressor, the air conditioning compressor operates as a backup for the refrigeration cabinet compressor.

Optionally, in an embodiment of the heat pump system, when the heat pump system operates in any mode, pressurized refrigerant at the exhaust end of the compressor unit is delivered to one of the air conditioning unit and the outdoor heat exchange unit.

According to another aspect, a control method for a heat pump system is provided, the method comprising: delivering pressurized refrigerant at the exhaust end of the compressor unit to one of the air conditioning unit and the outdoor heat exchange unit for condensation, and evaporating throttled refrigerant in the other of the air conditioning unit and the outdoor heat exchange unit and/or the refrigeration cabinet unit before being delivered back to the compressor unit.

Optionally, the method comprises: operating the heat pump system in any of the following modes:

a single air conditioning refrigeration mode, wherein the outdoor heat exchanger serves as a condenser, the air conditioning unit throttling device is used for throttling, and the air conditioning unit indoor heat exchanger serves as an evaporator, with all of the refrigeration cabinet unit throttling devices closed;

a single refrigeration cabinet refrigeration mode, wherein the outdoor heat exchanger serves as a condenser, the refrigeration cabinet unit throttling device is used for throttling, and the refrigeration cabinet unit indoor heat exchanger serves as an evaporator, with all of the air conditioning unit throttling devices closed; and an air conditioning and refrigeration cabinet dual refrigeration mode, wherein the outdoor heat exchanger serves as a condenser, a portion of refrigerant is throttled by the air conditioning unit throttling device and returns to the compressor unit after passing through the air conditioning unit indoor heat exchanger and the four-way valve, and the other portion of refrigerant is throttled by the refrigeration cabinet unit throttling device and returns to the compressor unit after passing through the refrigeration cabinet unit indoor heat exchanger;

a single air conditioning heating mode, wherein the air conditioning unit indoor heat exchanger serves as a condenser, the outdoor throttling device is used for throttling, and the outdoor heat exchanger serves as an evaporator, with all of the refrigeration cabinet unit throttling devices closed;

an all heat recovery mode, wherein the air conditioning unit indoor heat exchanger serves as a condenser, the refrigeration cabinet unit throttling device is used for throttling, and the refrigeration cabinet unit indoor heat exchanger serves as an evaporator, with the outdoor throttling device closed; and a partial heat recovery mode, wherein the air conditioning unit indoor heat exchanger serves as a condenser, a portion of refrigerant is throttled by the refrigeration cabinet unit throttling device and returns to the compressor unit after passing through the refrigeration cabinet unit indoor heat exchanger, and the other refrigerant is throttled by the outdoor throttling device and returns to the compressor unit after passing through the outdoor heat exchanger and the four-way valve.

Optionally, the method further comprises: in the all heat recovery mode, when the heating load of the air conditioning unit has been met and the refrigeration load of the refrigeration cabinet unit has not been fully met, switching the heat pump system to the single refrigeration cabinet refrigeration mode, wherein the heat pump system switches back to the all heat recovery mode after a certain time delay.

Optionally, the method further comprises: providing a subcooling device, wherein the subcooling heat exchanger is arranged between the outdoor throttling device side and the first port of the air conditioning unit, and the subcooling branch branches out from a main flow path upstream or downstream of the subcooling heat exchanger and is connected to the suction end of the compressor unit through the subcooling throttling device and the subcooling heat exchanger; and allowing a portion of refrigerant to pass through the subcooling branch and the subcooling throttling device and exchange heat with refrigerant in the main flow path in the subcooling heat exchanger to subcool the refrigerant in the main flow path.

The heat pump system according to the embodiments of the present invention integrates an air conditioning system and a refrigeration cabinet system, which simplifies the structure and operating mode of the heat pump system.

BRIEF DESCRIPTION OF THE DRAWINGS

With reference to the accompanying drawings, the disclosure of the present application will become easier to understand. Those skilled in the art would easily understand that these drawings are for the purpose of illustration, and are not intended to limit the protection scope of the present application. In addition, in the figures, similar numerals are used to denote similar components, where.

DETAILED DESCRIPTION OF EMBODIMENT(S) OF THE INVENTION

Figure 1:
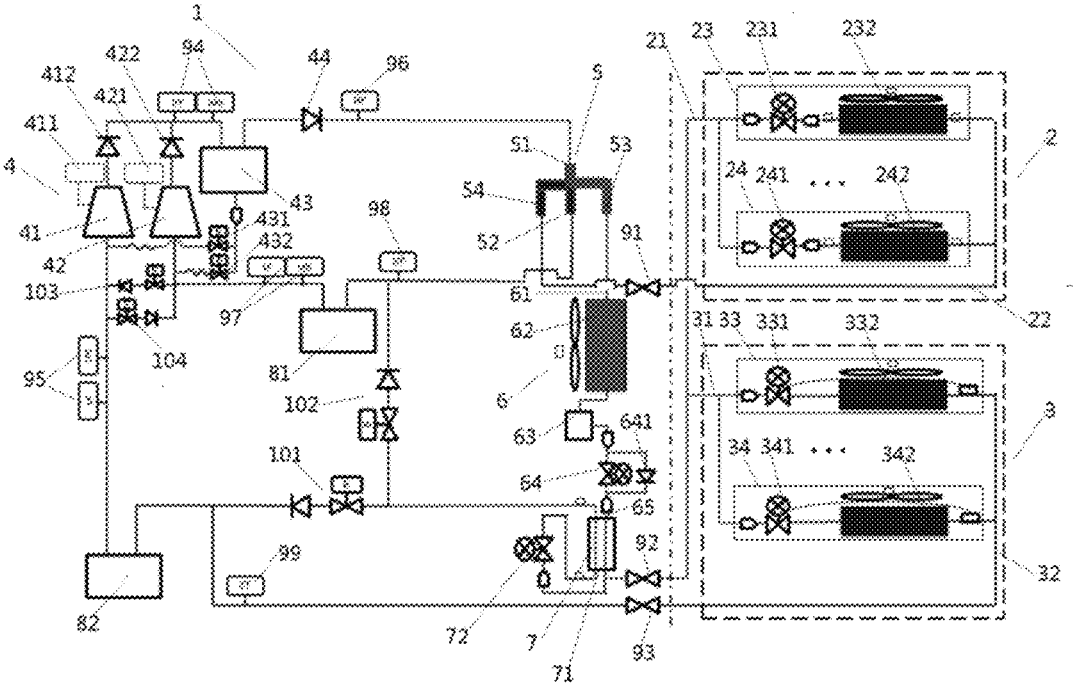
FIG. 1 shows a structural schematic diagram of a heat pump system according to an embodiment.

A heat pump system, also known as an integrated heat pump system that integrates an air conditioning system and a refrigeration cabinet system sharing an outdoor unit and a set of pipelines, according to an embodiment of the present invention, is described with reference to FIG. 1. More specifically, the heat pump system comprises: an indoor unit and an outdoor unit 1, wherein the indoor unit comprises: an air conditioning unit 2 and a refrigeration cabinet unit 3. The air conditioning unit 2 comprises one or more parallel branches 23, 24, the respective branch 23, 24 being provided with an air conditioning unit throttling device 231, 241 and an air conditioning unit indoor heat exchanger 232, 242. The air conditioning unit 2 comprises a first port 21 connected to the air conditioning unit throttling devices 231, 241 of the respective branches and a second port 22 connected to the air conditioning unit indoor heat exchangers 232, 242 of the respective branches. Each branch of the air conditioning unit 2 may correspond to, for example, an area inside the house. The refrigeration cabinet unit 3 comprises one or more parallel branches 33, 34, the respective branch 33, 34 being provided with a refrigeration cabinet unit throttling device 331, 341 and a refrigeration cabinet unit indoor heat exchanger 332, 342. The refrigeration cabinet unit comprises a first port 31 connected to the refrigeration cabinet unit throttling devices 331, 341 of the respective branches and a second port 32 connected to the refrigeration cabinet unit indoor heat exchangers 332, 342 of the respective branches. Each branch of the refrigeration cabinet unit can correspond to an independent refrigeration cabinet or an area of the refrigeration cabinet. The outdoor unit 1 comprises: a compressor unit 4, an outdoor heat exchange unit 6, and a switching device 5. The compressor unit 4 comprises one or more parallel compressors. As shown in the figure, the compressor unit 4 comprises an air conditioning compressor 41 for the air conditioning system and a refrigeration cabinet compressor 42 for the refrigeration cabinet system. In some embodiments, the air conditioning compressor 41 operates when the air conditioning unit 2 is in operation, and the refrigeration cabinet compressor 42 operates when the refrigeration cabinet unit 3 is in operation. When the air conditioning unit 2 and the refrigeration cabinet unit 3 are operating simultaneously, the air conditioning compressor 41 and the refrigeration cabinet compressor 42 operate simultaneously. The compressor unit 4 comprises a suction end and an exhaust end. The outdoor heat exchange unit 6 comprises an outdoor heat exchanger 62 and an outdoor throttling device 64 connected in series with the outdoor heat exchanger, and a bypass branch with a check valve 641 can be arranged in parallel with the outdoor throttling device 64. The outdoor heat exchange unit 6 comprises an outdoor heat exchanger side 61 and an outdoor throttling device side 65. The switching device 5 selectively connects the exhaust end of the compressor unit to one of the air conditioning unit 2 and the outdoor heat exchange unit 6, and connects the suction end of the compressor unit to the other of the air conditioning unit 2 and the outdoor heat exchange unit 6. In addition, the outdoor throttling device side 65 of the outdoor heat exchange unit is connected to the first port 21 of the air conditioning unit 2 and the first port 31 of the refrigeration cabinet unit 3, respectively. An optional subcooling heat exchanger 71 of a subcooling device 7 can be arranged between the outdoor throttling device side 65 and the first port 21 of the air conditioning unit 2. The subcooling branch branches out from the main flow path upstream or downstream of the subcooling heat exchanger, and is connected to the suction end of the compressor unit through the subcooling throttling device 72 and the subcooling heat exchanger 71. A portion of the refrigerant, after passing through the subcooling branch and the subcooling throttling device 72, exchanges heat with the refrigerant in the main flow path in the subcooling heat exchanger 71, so as to subcool the refrigerant in the main flow path. In addition, the second port 32 of the refrigeration cabinet unit 3 is connected to the suction end of the compressor unit.

The heat pump system according to the embodiments of the present invention has the characteristic of simple structure. In some embodiments, the switching device 5 can be implemented using a four-way valve. For example, only a single four-way valve is required to achieve the function of the switching device 5. The four-way valve comprises: a first port 51 connected to the exhaust end of the compressor unit, a second port 52 connected to the suction end of the compressor unit, a third port 53 connected to the outdoor heat exchanger side 61 of the outdoor heat exchange unit, and a fourth port 54 connected to the second port 22 of the air conditioning unit. The four-way valve can switch between a first position where the first port 51 is connected with the third port 53 and the second port 52 is connected with the fourth port 54 and a second position where the first port 51 is connected with the fourth port 54 and the second port 52 is connected with the third port 53.

Other devices of the outdoor unit are also shown in FIG. 1. In some embodiments, the outdoor heat exchange unit further comprises a subcooling device 7, which comprises a subcooling heat exchanger 71 and a subcooling throttling device 72 on the subcooling branch. In some embodiments, three interfaces are provided between the outdoor unit and the indoor unit, which correspond to a first cut-off valve 91, a second cut-off valve 92, and a third cut-off valve 93, respectively. The first cut-off valve 91 is located between the fourth port 54 of the switching device 5 and the second port 22 of the air conditioning unit. The second cut-off valve 92 is located between the outdoor throttling device side 65 of the outdoor heat exchange unit and the manifold of the first port 21 of the air conditioning unit and the first port 31 of the refrigeration cabinet unit. The third cut-off valve 93 is located between the suction end of the compressor unit and the second port 32 of the refrigeration cabinet unit. The outdoor unit can be sold, transported, or installed as individual equipment. Before being assembled into a system (i.e., before being connected to form a circulating circuit), the first cut-off valve 91, the second cut-off valve 92, and the third cut-off valve 93 can be closed separately, so that the pipelines of the outdoor unit is closed from the outside, so as to prevent impurities or dust from entering the interior of the pipelines of the outdoor unit. After the assembly is completed, these cut-off valves 91, 92, 93 can be kept open constantly, or they can be closed again during maintenance. In some embodiments, gas-liquid separators 81, 82 are respectively arranged on the two branches connected to the suction end of the compressor unit for gas-liquid separation, so as to avoid liquid hammer phenomenon in the compressor. In some embodiments, an oil separator 43 can be arranged at the exhaust end of the compressor unit and solenoid valves 431, 432 and capillaries are arranged in the corresponding flow paths, so as to recover the lubricating oil carried by the refrigerant and to prevent the refrigerant from entering. In some embodiments, oil heaters 411, 421 can be arranged in the compressor unit to heat the lubricating oil to improve its viscosity. In some embodiments, some sensors may also be included, including low-pressure sensors and low-pressure switches 95, 97, and suction temperature sensors 98, 99 arranged on the two branches at the suction end of the compressor, and a exhaust temperature sensor 96, and a high-pressure sensor and high pressure switch 94 arranged at the exhaust end of the compressor unit, and so on. In some embodiments, combined solenoid valves and check valves 101, 102, 103, 104 are also arranged on the two branches of the compressor suction inlet and the two branches of the subcooling branch of the subcooling heat exchanger, so as to control the on-off of these flow paths.

In some embodiments, the heat pump system comprises a controller that is in control connection with various valves and the switching devices 5, so as to operate the heat pump system in various modes. In the heat pump system according to the embodiments of the present invention, the exhaust end of the compressor unit is directly connected to the switching device 5, so that the compressed refrigerant flowing out of the exhaust end of the compressor unit is directed to the outdoor heat exchange unit 6 or the air conditioning unit 2 without being splitted. Therefore, when the heat pump system operates in any mode, the pressurized refrigerant at the exhaust end of the compressor unit is delivered to one of the air conditioning unit 2 and the outdoor heat exchange unit 6 for condensation.

Figure 2:
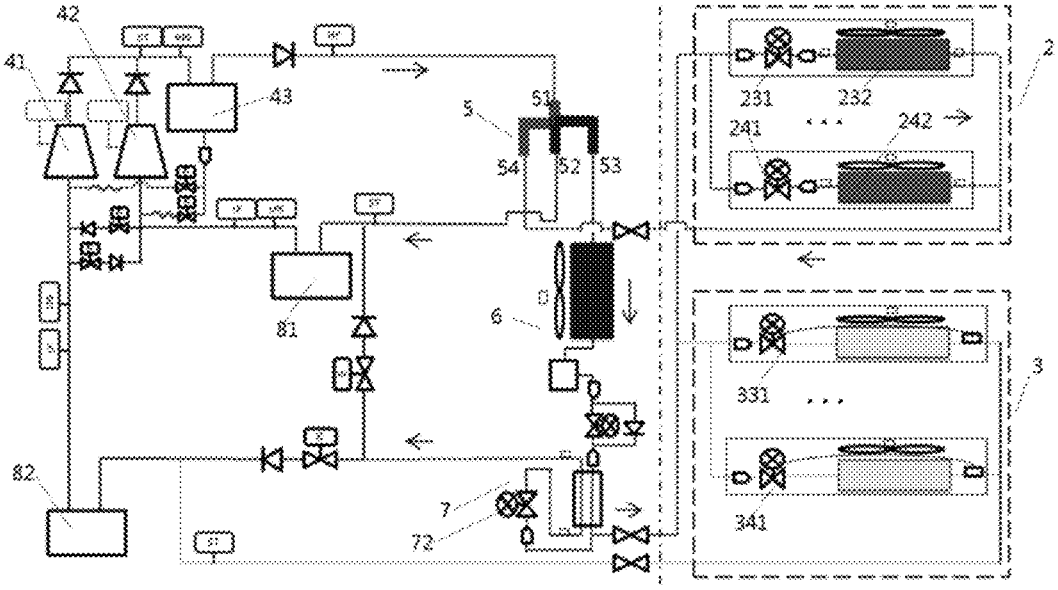
FIGS. 2-7 show various operating modes of the heat pump system according to an embodiment.
Figure 3:
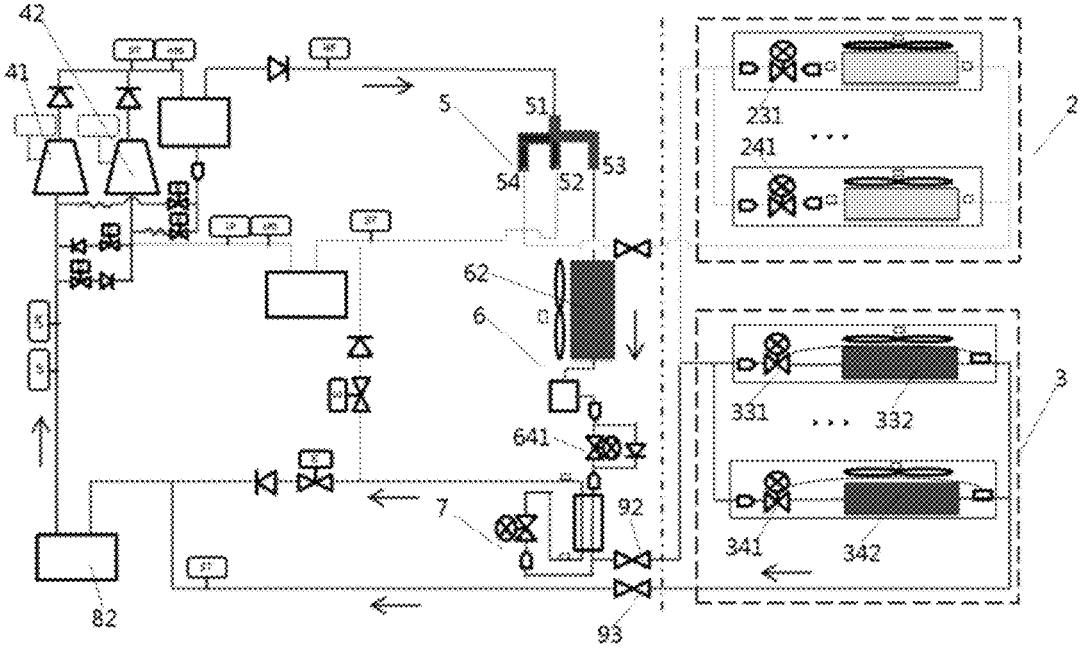
Figure 4:
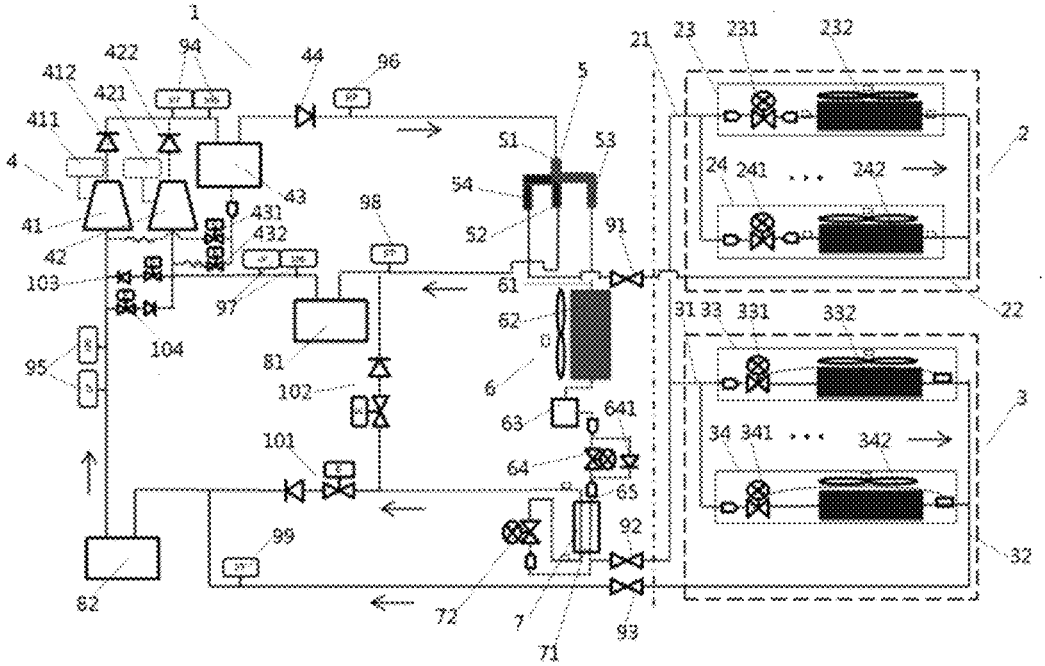

FIGS. 2 to 4 correspond to three modes in which all the pressurized refrigerant discharged by the compressor unit condenses in the outdoor heat exchanger 62 of the outdoor heat exchange unit 6, i.e., in which the four-way valve is in the first position where its first port 51 and third port 53 are connected. These three modes include the single air conditioning refrigeration mode shown in FIG. 2, the single refrigeration cabinet refrigeration mode shown in FIG. 3, and the air conditioning and refrigeration cabinet dual refrigeration mode shown in FIG. 4. It should be appreciated that although a single outdoor heat exchanger 62 is shown, in alternative embodiments, however, there may be a plurality of outdoor heat exchangers, which may be connected in parallel, for example.

More specifically, referring to FIG. 2, in the single air conditioning refrigeration mode, the pressurized refrigerant at the exhaust end of the compressor unit passes through the first port 51 of the switching device 5 to the third port 53 thereof. The outdoor heat exchanger 62 serves as the condenser for condensing the refrigerant. Since the outdoor throttling device is bypassed, after the refrigerant passes through the subcooling heat exchanger 71, a small portion of the refrigerant passes through the subcooling branch and the subcooling throttling device 72 arranged thereon, and exchanges heat with other refrigerant in the subcooling heat exchanger 71 before returning to the compressor, whereas, most of the refrigerant enters the air conditioning unit 2. At least one of the air conditioning unit throttling devices 231, 241 (some of which may be closed) is used for throttling, and the corresponding air conditioning unit indoor heat exchangers 232, 242 serve as the evaporator. All the refrigeration cabinet unit throttling devices 331, 341 are closed, so that no refrigerant passes through the refrigeration cabinet unit 3. Then, the refrigerant returns to the suction end of the compressor unit after passing through the fourth port 54 and second port 52 of the switching device 5. In this mode, only the air conditioning compressor 41 is turned on, while the refrigeration cabinet compressor 42 is turned off.

Referring to FIG. 3, in the single refrigeration cabinet refrigeration mode, similarly, the outdoor heat exchanger 62 serves as the condenser, at least one of the refrigeration cabinet unit throttling devices 331, 341 (some of which may be closed) is used for throttling, and the corresponding refrigeration cabinet unit indoor heat exchangers 332, 342 serves as the evaporator. All air conditioning unit throttling devices 231, 241 are closed, so that the refrigerant passing through the refrigeration cabinet unit directly returns to the suction end of the compressor unit without passing through the switching device 5. In this mode, only the refrigeration cabinet compressor 42 can be turned on, or both the air conditioning compressor 41 and the refrigeration cabinet compressor 42 can be turned on simultaneously.

Referring to FIG. 4, in the air conditioning and refrigeration cabinet dual refrigeration mode, similarly, the outdoor heat exchanger 62 serves as the condenser. A portion of the refrigerant is throttled by at least one of the air conditioning unit throttling devices 231, 241, and returns to the compressor after passing through the corresponding air conditioning unit indoor heat exchangers 232, 242 and the four-way valve 5. The other portion of the refrigerant is throttled by at least one of the refrigeration cabinet unit throttling devices 331, 341, and returns to the compressor after passing through the corresponding refrigeration cabinet unit indoor heat exchangers 332, 342. In this mode, both the air conditioning compressor 41 and the refrigeration cabinet compressor 42 can be turned on. The air conditioning unit indoor heat exchanger and the refrigeration cabinet unit indoor heat exchanger in operation are all served as evaporators.

Figure 5:
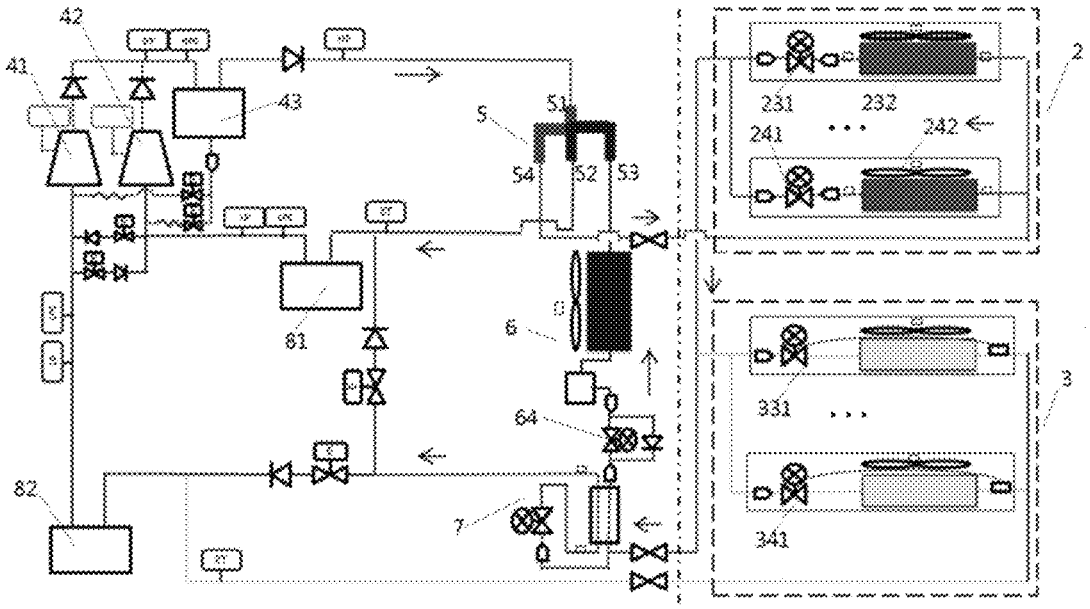
Figure 6:
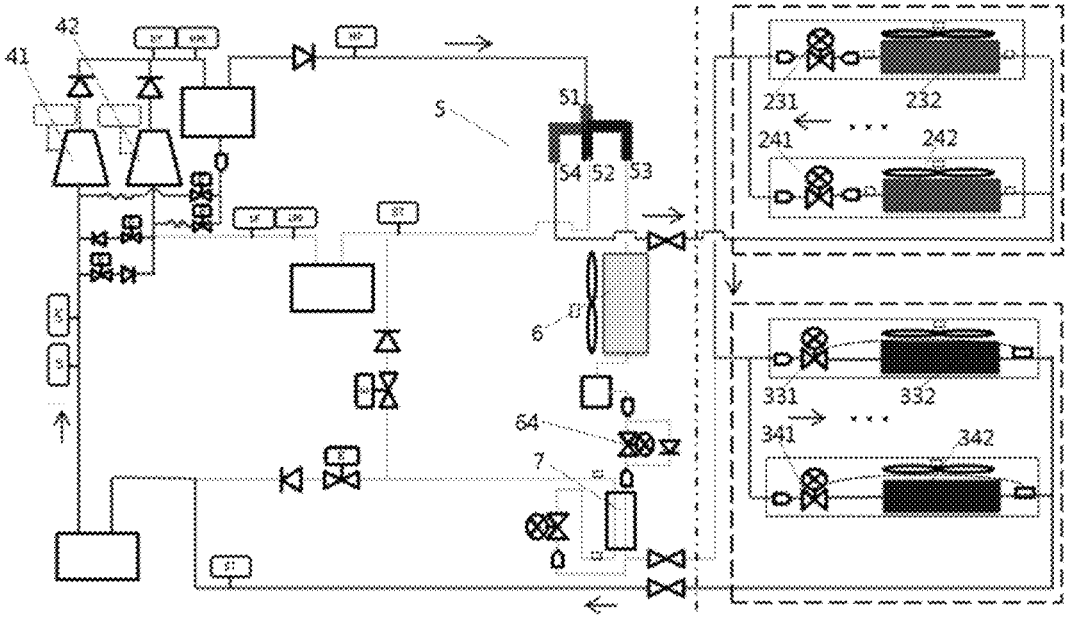
Figure 7:
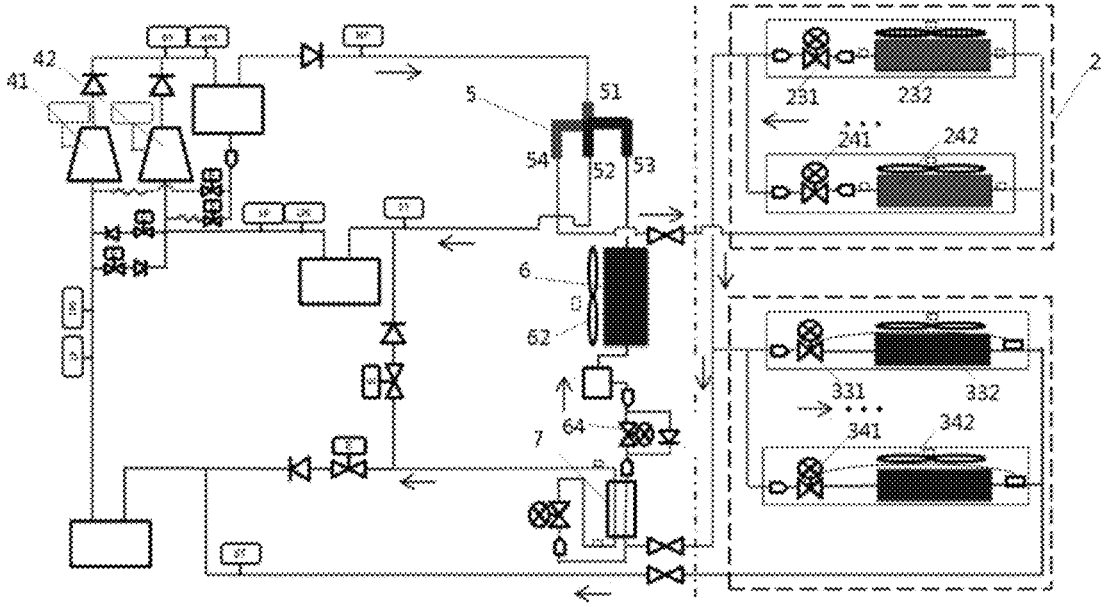

FIGS. 5 to 7 correspond to three modes in which all the pressurized refrigerant discharged by the compressor unit condenses in the air conditioning unit 2, i.e., when the four-way valve is in the second position, where its first port 51 and the fourth port 54 are connected. These three modes include the single air conditioning heating mode shown in FIG. 5, the all heat recovery mode shown in FIG. 6, and the partial heat recovery mode shown in FIG. 7.

In the single air conditioning heating mode shown in FIG. 5, the pressurized refrigerant discharged at the exhaust end of the compressor unit enters the air conditioning unit 2 after passing through the first port 51 and fourth port 54 of the switching device 5. Wherein, at least a portion of the air conditioning unit indoor heat exchangers 232, 242 serve as the condenser. The air conditioning unit throttling device 231, 241 can be used to adjust the flow of each branch or can be kept closed. Then, the pressurized refrigerant is throttled by the outdoor throttling device 64 after passing through the subcooling heat exchanger, where the outdoor heat exchanger 62 serves as the evaporator, and returns to the compressor after passing through the third port 53 and second port 52 of the switching device 5. At this point, both the refrigeration cabinet unit throttling devices 331, 341 are closed. In this mode, only the air conditioning compressor 41 can be turned on.

In the all heat recovery mode shown in FIG. 6, similarly, at least one of the air conditioning unit indoor heat exchangers 232, 242 serves as the condenser. The air conditioning unit throttling device 231, 241 can be used to adjust the flow of each branch or can be closed. At least one of the refrigeration cabinet unit throttling devices 331, 341 is used for throttling, while the corresponding refrigeration cabinet unit indoor heat exchangers 332, 342 serves as the evaporator. The outdoor throttling device 64 of the outdoor heat exchange unit is in a closed state. In this mode, two compressors 41, 42 can be turned on simultaneously.

In the partial heat recovery mode shown in FIG. 7, similarly, at least one of the air conditioning unit indoor heat exchangers 232, 242 serves as the condenser, and the air conditioning unit throttling devices 231, 241 can be used to adjust the flow of each branch or can be closed. A portion of refrigerant is throttled by at least one of the refrigeration cabinet unit throttling devices 331, 341, and returns to the compressor after being evaporated by the corresponding refrigeration cabinet unit indoor heat exchangers 332, 342. The other refrigerant is throttled by the outdoor throttling device 64, and returns to the compressor after passing through the outdoor heat exchanger 62 and the third port 53 and second port 52 of the four-way valve. In this mode, two compressors 41, 42 can be turned on simultaneously.

In some embodiments, when the controller of the heat pump system according to the embodiments of the present invention is configured to operate in the all heat recovery mode, when the heating load of the air conditioning unit has been met and the refrigeration load of the refrigeration cabinet unit has not been fully met, the heat pump system switches to the single refrigeration cabinet unit refrigeration mode, and switches back to the all heat recovery mode after a certain time delay. This time delay can be determined based on the actual load situation or can be a fixed value. Through this kind of mode switch, it is possible to cope with situations where the air conditioning heating load has been met but the refrigeration load of the refrigeration cabinet has not been met, and to recover heat as much as possible.

In addition, a control method for a heat pump system is further provided, such as any heat pump system as described above. The method comprises: delivering pressurized refrigerant at the exhaust end of the compressor unit to one of the air conditioning unit and the outdoor heat exchange unit for condensation, and evaporating throttled refrigerant in the other of the air conditioning unit and the outdoor heat exchange unit and/or the refrigeration cabinet unit before being delivered back to the compressor unit. In some embodiments, the method further comprises: in the all heat recovery mode, when the heating load of the air conditioning unit has been met and the refrigeration load of the refrigeration cabinet unit has not been fully met, switching the heat pump system to the single refrigeration cabinet refrigeration mode, wherein the heat pump system switches back to the all heat recovery mode after a certain time delay. In addition, other than the all heat recovery mode shown in FIG. 6, the subcooling heat exchanger 71 can always function to provide subcooling to the fluid on the main flow path, thereby improving the efficiency of the heat pump system.

It should be appreciated that the internal temperature of the refrigeration cabinet needs to be strictly controlled so as to meet the temperature requirements of the goods, otherwise the goods will be spoilaged. When the refrigeration cabinet compressor 42 is abnormal and unable to operate during pratical operation, the operation of the compressor unit is controlled based on the principle of giving priority to the refrigeration cabinet, so that the air conditioning compressor serves as a backup for the refrigeration cabinet compressor to achieve operation of the refrigeration cabinet.

The specific embodiments described above in the present application are merely intended to describe the principles of the present application more clearly, wherein various components are clearly shown or described to facilitate the understanding of the principles of the present invention. Those skilled in the art may, without departing from the scope of the present application, make various modifications or changes to the present application. Therefore, it should be understood that these modifications or changes should be included within the scope of patent protection of the present application.

What is claimed is:

1. A heat pump system, comprising:

an indoor unit, comprising:

an air conditioning unit provided with an air conditioning unit throttling device and an air conditioning unit indoor heat exchanger;

a refrigeration cabinet unit provided with a refrigeration cabinet unit throttling device and a refrigeration cabinet unit indoor heat exchanger;

an outdoor unit, comprising:

a compressor unit;

an outdoor heat exchange unit, comprising an outdoor heat exchanger and an outdoor throttling device;

a switching device for selectively connecting the exhaust end of the compressor unit to one of the air conditioning unit and the outdoor heat exchange unit; and an outdoor throttling device side of the outdoor heat exchange unit; and a controller configured to:

control the heat pump system to execute at least two modes comprising a single air conditioning refrigeration mode, a single refrigeration cabinet refrigeration mode, an air conditioning and refrigeration cabinet dual refrigeration mode, a single air conditioning heating mode, an all heat recovery mode, and/or a partial heat recovery mode; and control the heat pump system to switch between the at least two modes after a certain time delay.

2. The heat pump system according to claim 1, wherein the switching device comprises a four-way valve, the four-way valve comprising: a first port connected to the exhaust end of the compressor unit, a second port connected to the suction end of the compressor unit, a third port connected to an outdoor heat exchanger side of the outdoor heat exchanger unit, and a fourth port connected to the second port of the air conditioning unit, wherein the four-way valve is capable of switching between a first position where the first port is connected with the third port and the second port is connected with the fourth port, and a second position where the first port is connected with the fourth port and the second port is connected with the third port, where optionally, the switching device consists of a single four-way valve.

3. The heat pump system according to claim 2, further comprising:

in the single air conditioning refrigeration mode, the outdoor heat exchanger serves as a condenser, the air conditioning unit throttling device is used for throttling, and the air conditioning unit indoor heat exchanger serves as an evaporator, with all of the refrigeration cabinet unit throttling devices closed;

in the single refrigeration cabinet refrigeration mode, wherein the outdoor heat exchanger serves as a condenser, the refrigeration cabinet unit throttling device is used for throttling, and the refrigeration cabinet unit indoor heat exchanger serves as an evaporator, with all of the air conditioning unit throttling devices closed;

in the air conditioning and refrigeration cabinet dual refrigeration mode, wherein the outdoor heat exchanger serves as a condenser, a portion of refrigerant is throttled by the air conditioning unit throttling device and returns to the compressor unit after passing through the air conditioning unit indoor heat exchanger and the four-way valve, and the other portion of refrigerant is throttled by the refrigeration cabinet unit throttling device and returns to the compressor unit after passing through the refrigeration cabinet unit indoor heat exchanger; and in the single air conditioning heating mode, wherein the air conditioning unit indoor heat exchanger serves as a condenser, the outdoor throttling device is used for throttling, and the outdoor heat exchanger serves as an evaporator, with all of the refrigeration cabinet unit throttling devices closed;

in the all heat recovery mode, wherein the air conditioning unit indoor heat exchanger serves as a condenser, the refrigeration cabinet unit throttling device is used for throttling, and the refrigeration cabinet unit indoor heat exchanger serves as an evaporator, with the outdoor throttling device closed; and/or in the partial heat recovery mode, wherein the air conditioning unit indoor heat exchanger serves as a condenser, a portion of refrigerant is throttled by the refrigeration cabinet unit throttling device and returns to the compressor unit after passing through the refrigeration cabinet unit indoor heat exchanger, and the other refrigerant is throttled by the outdoor throttling device and returns to the compressor unit after passing through the outdoor heat exchanger and the four-way valve.

4. The heat pump system according to claim 3, wherein in the all heat recovery mode, when a heating load of the air conditioning unit has been met and a refrigeration load of the refrigeration cabinet unit has not been fully met, the heat pump system switches to the single refrigeration cabinet refrigeration mode, where the heat pump system switches back to the all heat recovery mode.

5. The heat pump system according to claim 1, wherein the outdoor heat exchange unit further comprises a subcooling device, the subcooling device comprising a subcooling heat exchanger and a subcooling throttling device on a subcooling branch, wherein the subcooling heat exchanger is arranged between the outdoor throttling device side and the first port of the air conditioning unit, and the subcooling branch branches out from a main flow path upstream or downstream of the subcooling heat exchanger and is connected to the suction end of the compressor unit through the subcooling throttling device and the subcooling heat exchanger.

6. The heat pump system according to claim 1, wherein the compressor unit comprises an air conditioning compressor and a refrigeration cabinet compressor connected in parallel, wherein the air conditioning compressor operates when the air conditioning unit is in operation, and the refrigeration cabinet compressor operates when the refrigeration cabinet unit is in operation, where in the event of a failure of the refrigeration cabinet compressor, the air conditioning compressor operates as a backup for the refrigeration cabinet compressor.

7. The heat pump system according to claim 1, wherein when the heat pump system operates in any mode, pressurized refrigerant at the exhaust end of the compressor unit is delivered to one of the air conditioning unit and the outdoor heat exchange unit.

8. The heat pump system according to claim 1, wherein the air conditioning unit further comprises one or more parallel branches, each of which is provided with the air conditioning unit throttling device and the air conditioning unit indoor heat exchanger, wherein the air conditioning unit comprises a first port connected to the air conditioning unit throttling device of each branch and a second port connected to the air conditioning unit indoor heat exchanger of each branch.

9. The heat pump system according to claim 1, wherein the refrigeration cabinet unit further comprises one or more parallel branches, each of which is provided with the refrigeration cabinet unit throttling device and the refrigeration cabinet unit indoor heat exchanger, wherein the refrigeration cabinet unit comprises a first port connected to the refrigeration cabinet unit throttling device of each branch and a second port connected to the refrigeration cabinet unit indoor heat exchanger of each branch.

10. A heat pump system, comprising:

an indoor unit comprising:

an air conditioning unit comprising an air conditioning unit indoor heat exchanger; and a refrigeration cabinet unit comprising a refrigeration cabinet unit indoor heat exchanger;

an outdoor unit comprising:

an outdoor heat exchanger; and a controller configured to enable the heat pump system to execute a plurality of modes:

wherein at least two of the plurality of modes comprises an all heat recovery mode and a single refrigeration cabinet refrigeration mode, wherein in the all heat recovery mode, when a heating load of the air conditioning unit has been met and a refrigeration load of the refrigeration cabinet has not been fully met, the heat pump system switches to the single refrigeration cabinet refrigeration mode.

11. The heat pump system according to claim 10, wherein after a certain time delay the heat pump system switches back to the all heat recovery mode.

12. The heat pump system according to claim 10, wherein in the all heat recovery mode, the air conditioning unit indoor heat exchanger serves as a condenser and the refrigeration cabinet unit indoor heat exchanger serves as an evaporator.

13. The heat pump system according to claim 10, wherein in the single cabinet refrigeration mode, the outdoor heat exchanger serves as the condenser and the refrigeration cabinet unit indoor heat exchanger serves as an evaporator.

14. The heat pump system according to claim 12, wherein in the single cabinet refrigeration mode, the outdoor heat exchanger serves as the condenser and the refrigeration cabinet unit indoor heat exchanger serves as an evaporator.

* * * * *